US007063284B2

(12) United States Patent
Modesti et al.

(10) Patent No.: US 7,063,284 B2
(45) Date of Patent: Jun. 20, 2006

(54) APPARATUS FOR ROUGHING EDGES OF CONCRETE CASTED BLOCKS

(76) Inventors: Natalino Modesti, 11770 Damase Potvin, Montréal, Québec (CA) H1E 3H8; Eric Milot, 10395 Laverdure, Ahuntaic, Québec (CA) H3L 2L5; Louis-R Allard, 130 des Patriotes, Bromont, Québec (CA) J2L 2R6

( * ) Notice: Subject to any disclaimer, the term of this patent is extended or adjusted under 35 U.S.C. 154(b) by 118 days.

(21) Appl. No.: 10/817,442

(22) Filed: Apr. 2, 2004

(65) Prior Publication Data

US 2004/0256508 A1 Dec. 23, 2004

(30) Foreign Application Priority Data

Apr. 4, 2003 (CA) ..... 2423740

(51) Int. Cl.
*B02C 19/12* (2006.01)

(52) U.S. Cl. ..... 241/197; 241/283; 425/343

(58) Field of Classification Search ..... 241/197, 241/283, 264, 265; 425/343
See application file for complete search history.

(56) References Cited

U.S. PATENT DOCUMENTS 6,561,786 B1 5/2003 Ciccarello ..... 425/343
6,575,727 B1 6/2003 Ciccarello et al. ..... 425/343

*Primary Examiner*—Mark Rosenbaum
(74) *Attorney, Agent, or Firm*—Wells St. John P.S.

(57) ABSTRACT

An apparatus for roughing edges of solid concrete casted blocks that includes a block support conveyor for supporting and conveying a series of blocks and at least one roughing device disposed at a given distance from a block to be roughened; the device includes at least one impacting arm having a first end connected to a drive shaft having an axis and a second end connected to an impacting element; the shaft is connected to a drive element allowing the shaft to define an arcuate reciprocating motion causing the impacting element to impact the block and to crumble concrete from an edge of the block. The arm impacts the edge at an angle of about 45° relative to the axis of the drive shaft.

11 Claims, 2 Drawing Sheets

APPARATUS FOR ROUGHING EDGES OF CONCRETE CASTED BLOCKS

PRIORITY CLAIM

This patent claims priority from an earlier filed Canadian Patent Application No. 2,423,740, filed April 4, 2003, for "Apparatus for Roughing Edges of Concrete Casted Blocks", by inventors Natalino Modesti, Eric Milot, and Louis-R Allard.

FIELD OF THE INVENTION

The present invention relates to casted concrete blocks, and more particularly, to an apparatus for roughing blocks to give them a worn or rough appearance.

BACKGROUND OF THE INVENTION

Casted concrete blocks have a rectangular configuration in which the surfaces are substantially planar with adjacent surfaces delimited by sharp edges.

It has been known to treat the concrete blocks in order to get a more natural rough look which is typical of an authentic stone block.

Various apparatuses have been devised in order to provide this rough surface appearance to concrete casted blocks. For example, U.S. Pat. No. 6,561,786 issued May 13, 2003 and U.S. Pat. No. 6,575,727 issued Jun. 10, 2003, both in the name of Techo-Bloc Inc. describe an apparatus for roughing surfaces of concrete casted blocks wherein the surfaces to be roughened are impacted by means of chain links attached to a disk rotatably driven by a drive shaft. Means are provided to mount the blocks so that the chain links may abrade the edges of the blocks. Another apparatus is described in U.S. Pat. No. 6,109,906 to Castonguay et al. for treating concrete blocks and includes flails mounted to a drive shaft which is adapted to rotate in opposite directions provide a balanced distribution of impacts at the corners of the blocks.

It has been found that the devices described in the prior art provide, through a chiseling effect, an abrasion of the edges of the blocks causing them to burst.

OBJECTS AND STATEMENT OF THE INVENTION

It is an object of the present invention to overcome the above problem associated with the present method of roughing edges of solid concrete casted blocks.

This is achieved by exert a crumbling effect along the edges thus providing them with a rounded appearance. This is achieved by impacting the edges at an angle of about 45°.

The present invention therefore provides an apparatus for roughing edges of solid concrete casted blocks which comprises:

a block support conveyor for supporting and conveying a series of blocks;

at least one roughing device disposed at a given distance from a block to be roughened; the device including at least one rigid impacting arm having one end connected to a drive shaft, having an axis, and an opposite end connected to an impacting element; the shaft is connected to drive means allowing the shaft to define an arcuate reciprocating motion causing the impacting element to impact the block and to crumble concrete from the edge of the block; the rigid arm impacting the edge at an angle of about 45° relative to the axis of the drive shaft; and means securing the block during impact.

In one form of the invention, the roughing device is formed of a series of impacting arms adjacently disposed to one another.

In another form of the invention, the roughing device includes a second series of impacting arms disposed adjacently to one another and mounted to the shaft at about 90° relative to the first series of impacting arms.

In a further embodiment of the present invention, there is provided a second drive shaft which is parallel to the axis of the first drive shaft and which includes one or more roughing devices as described above.

Other objects and further statement of the invention will be evident from the description given hereinafter.

IN THE DRAWINGS

DESCRIPTION OF PREFERRED EMBODIMENTS

Figure 1:
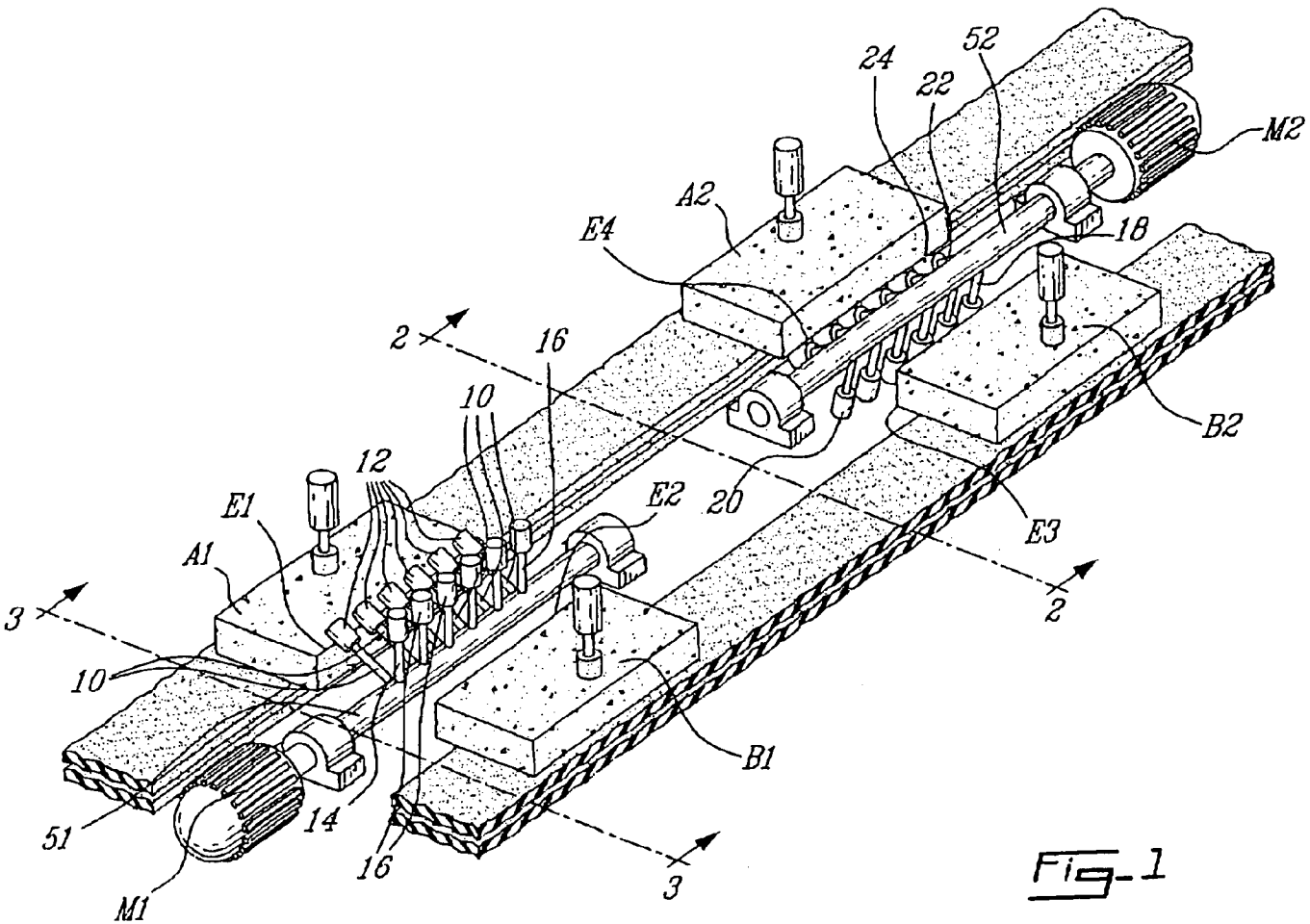
FIG. 1 is a schematic perspective view of one embodiment of an apparatus made in accordance with the present invention.

Referring to FIG. 1, there is shown an apparatus, roughing edges of solid concrete casted blocks (four being shown as A1, A2, B1 and 82).

After having being split to form individual blocks, the latter are supported and conveyed on two conveyors C and D disposed parallel to one another. In the space between the two conveyors are mounted a series of roughing devices.

A first roughing device comprises a motor M1 adapted to drive a shaft S1 on which is mounted a series of impacting arms (six being shown as 10), each displaying at its free end an impacting element 12 so disposed as to contact the edge E1 of block A1 at a 45° angle.

A second series of impacting arms 14 is disposed at about a 90° angle relative to the arms 10. Arms 14 are mounted to the shaft S1 and are adapted to contact by means of their impacting elements 16 the upper edge E2 on the block B1. Motor M1 is adapted to provide a reciprocating motion of the shaft S1 and of the arms 10 and 14.

In another embodiment of the present invention, there is provided a second motor M2 driving shaft 62 to which is mounted, on one side, a series of impacting arms 18 with their respective impacting elements 20 which contact the lower edge E3 of block B2. On the other side of shaft S2, a series of impacting arms 22 is mounted, each arm having an impacting element 24 to contact the lower edge E4 of block A2.

Figure 2:
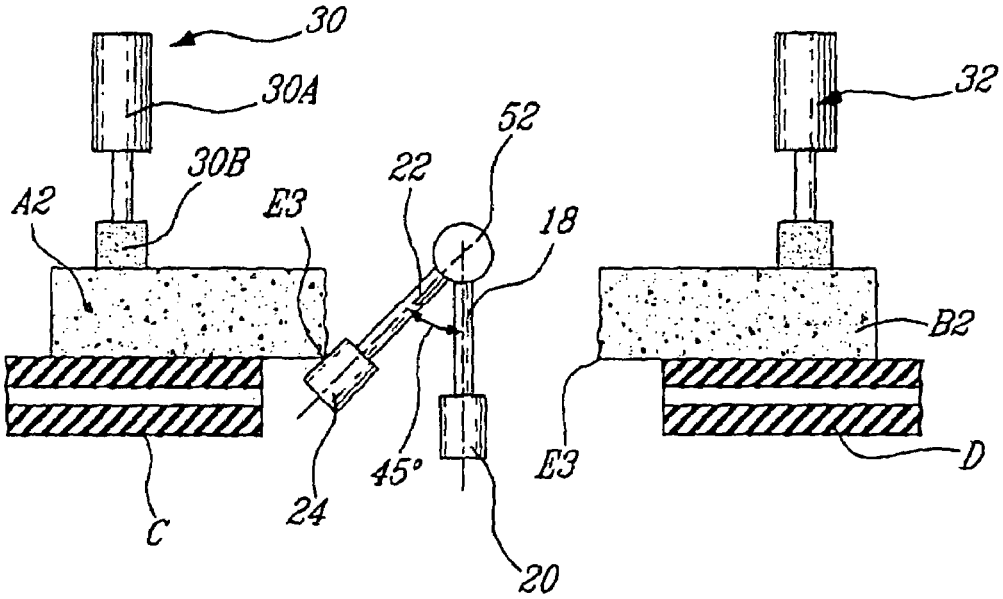
FIG. 2 is a cross-sectional view taken along lines 2—2 of FIG. 1.
Figure 3:
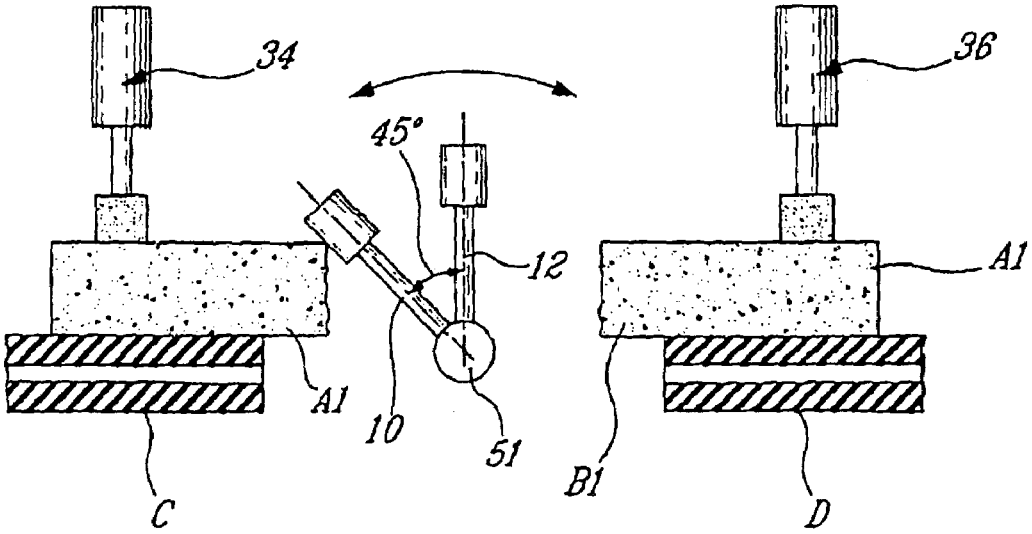
FIG. 3 is a cross-sectional view taken along lines 3—3 of FIG. 1.

As shown in FIGS. 2 and 3, the apparatus of the present invention comprises securing means 30, 32, 34 and 36 each consisting of a cylinder 30A and of a rubber rubber 30B to secure the blocks during the impact operation.

One suitable impacting element is one made of an impact resistant material, such as metal, and has a cylindrical shape.

Although the shaft arrangements illustrated in the drawings are longitudinally spaced from one another in the space between the conveyors, it is foreseen that some arrangement could be provided to have a single shaft with four sets of roughening devices 10–12, 14–16, 18–20 and 22–24 mounted thereon at 90° relative to one another or to have the two shafts S1 and S2 parallel to one another so that the upper and lower edges could be roughened simultaneously. Also, there are various ways to present the blocks for the roughening operation; for example, means could be provided to lift them to a roughening position. However, such mechanisms do not form part of the present invention.

It is therefore wished that the present invention should not be limited in interpretation, except by the terms of the following claims.

The invention claimed is:

1. An apparatus for roughing edges of solid concrete casted blocks comprising:

a block support conveyor for supporting and conveying a series of blocks;

at least one roughing device disposed at a given distance from a block to be roughened; said device including at least one impacting arm having a first end connected to a drive shaft having an axis and a second end connected to an impacting element; said shaft being connected to drive means allowing said shaft to define an arcuate reciprocating motion causing said impacting element to impact said block and to crumble concrete from an edge of said block; said at least one impacting arm configured to impact said edge at an angle of about 45° relative to the axis of said drive shaft; and means securing said block during impact.

2. The apparatus as defined in claim 1, wherein said at least one roughing device includes a first series of impacting arms adjacently disposed to one another and mounted on said shaft to crumble said block at different locations along said edge thereof.

3. The apparatus as defined in claim 2, wherein said at least one roughing device includes a second series of impacting arms disposed adjacently to one another and mounted on said shaft at about 90° relative to said first series of impacting arms; said apparatus further including a second block support for supporting and conveying a second block.

4. The apparatus as defined in claim 1, further comprising a second drive shaft having an axis parallel to the axis of said first drive shaft and including at least one second roughing device having at least one rigid arm having a first end connected to said second drive shaft and a second end connected to an impacting element; said second drive shaft being connected to second drive means allowing said second drive shaft to define an accurate reciprocating motion causing said impacting element to impact said block and to crumble concrete from another edge of said block.

5. The apparatus as defined in claim 4, wherein said roughing device on said second drive shaft includes a first series of said impacting arms adjacently disposed to one another and mounted on said shaft to crumble said block at different locations along said other edge thereof.

6. The apparatus as defined in claim 5, wherein said second roughing device on said second drive shaft includes a second series of impacting arms disposed adjacently to one another and mounted on said second drive shaft at about 90° relative to said first series of impacting arms on said second drive shaft; said apparatus further including a second block support for supporting and conveying said block.

7. The apparatus as defined in claim 4, wherein said drive shafts are in a same vertical plane between said block support conveyors.

8. The apparatus as defined in claim 4, wherein said drive shafts are longitudinally spaced from one another between said block support conveyors.

9. The apparatus as defined in claim 3, wherein said at least one roughing device includes a third and a fourth series of said impacting arms disposed adjacently to one another and mounted on said shaft; said third and fourth series being disposed at a 90° angle relative to said first and second series so as to cause said impacting elements to impact said blocks mounted an two adjacent conveyor means and to crumble concrete from an opposite lower edge of said blocks.

10. The apparatus as defined in claim 1, wherein said impacting element is made of an impact resistant material.

11. The apparatus as defined in claim 10, wherein said impact resistant material is a metal and has a cylindrical shape.

* * * * *